United States Patent [19]

van Riesen

[11] Patent Number: 5,067,211

[45] Date of Patent: Nov. 26, 1991

[54] BELT LOCK FOR BELT STRAP RETAINING SYSTEMS

[76] Inventor: Reiner van Riesen, Besenheide 36, 2200 Elmshorn, Fed. Rep. of Germany

[21] Appl. No.: 542,301

[22] Filed: Jun. 22, 1990

[30] Foreign Application Priority Data

Jun. 23, 1989 [DE] Fed. Rep. of Germany ..... 3920565

[51] Int. Cl.[5] ..... A44B 11/25

[52] U.S. Cl. ..... 24/641; 24/633

[58] Field of Search ..... 24/641, 640, 633, 635, 24/636, 637, 642, 652, 653

[56] References Cited

U.S. PATENT DOCUMENTS

| | | | |
|---|---|---|---|
| 4,597,141 | 7/1986 | Wier | 24/633 |
| 4,642,858 | 2/1987 | Ishiguro et al. | 24/641 |
| 4,870,726 | 10/1989 | Eksell et al. | 24/641 |
| 4,920,620 | 5/1990 | Yamamoto et al. | 24/641 |

FOREIGN PATENT DOCUMENTS

| | | |
|---|---|---|
| 0083752 | 12/1982 | European Pat. Off. . |
| 0252403 | 6/1987 | European Pat. Off. . |

*Primary Examiner*—Victor N. Sakran

*Attorney, Agent, or Firm*—Dvorak and Traub

[57] ABSTRACT

The belt lock comprises a closing mechanism and at least one ejectable belt strap end piece, which is able to be inserted therein, and which has a tongue which is able to be locked with the mechanism. The mechanism consists of a U-shaped metal frame, of a locking member, mounted in its lateral recesses, for the locking of the tongue, of an ejector for the tongue, a locking member support and of a release button. In order to further simplify the belt lock and to be able to manufacture it more cheaply, the locking member is constructed as a component in the shape of a small plate, the lateral recesses in the metal frame for the mounting of the locking member consist of elongated holes, which extend parallel to the direction of movement of the tongue in the frame and are dimensioned such that the pins of the locking member are guided so as to be movable in the direction of movement of the tongue, but substantially free of play vertically thereto. The cross-piece of the U-shaped metal frame has a stop for the fixing of the stop location of the locking member, and the locking member support is arranged behind the locking member above the ejector and is movable at least substantially parallel to the direction of movement of the ejector.

7 Claims, 3 Drawing Sheets

BELT LOCK FOR BELT STRAP RETAINING SYSTEMS

Figure 1:
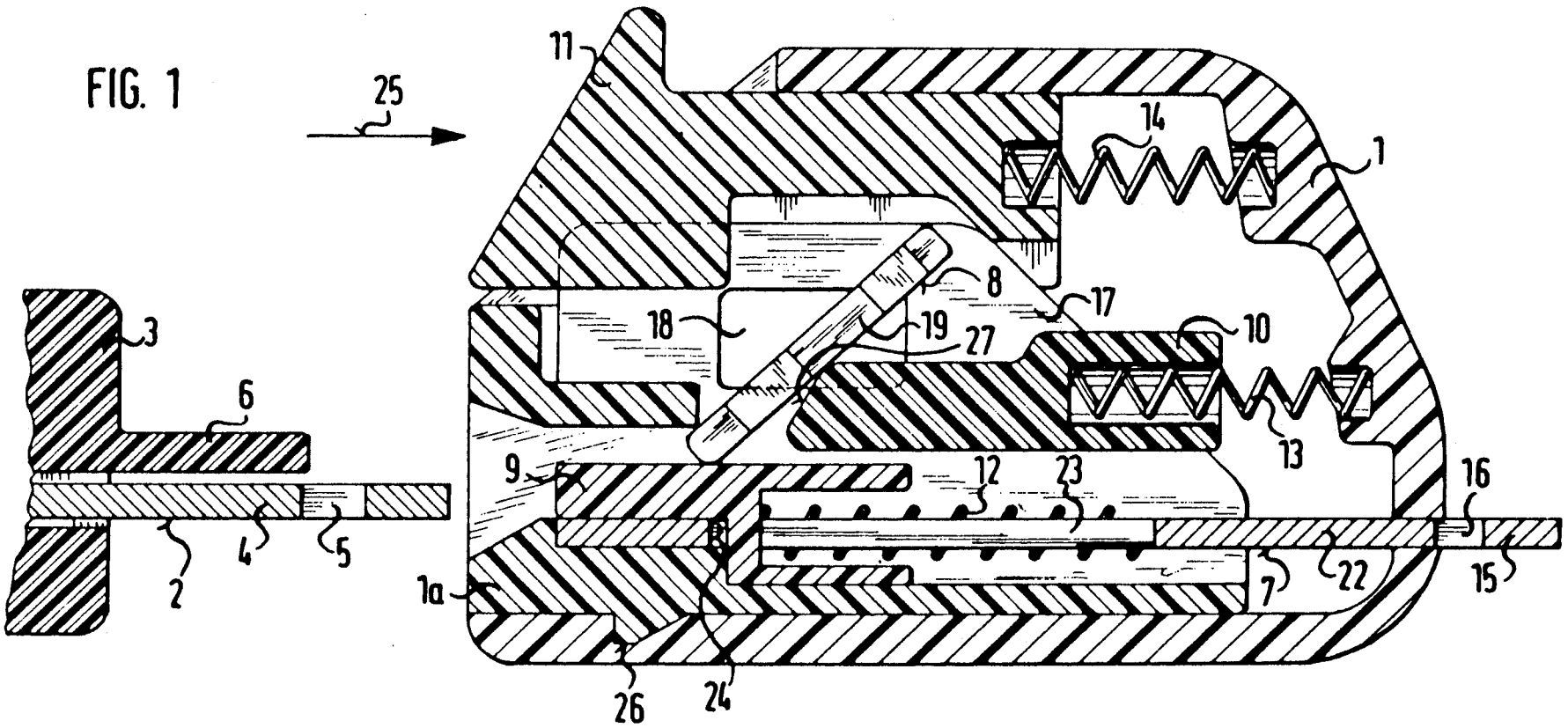

The invention proceeds from a belt lock for belt strap retaining systems, comprising a closing mechanism and at least one belt strap end piece which is able to be inserted therein and which is able to be ejected by pressing a button, wherein the end piece has a tongue which is able to be locked with the mechanism by means of a control member on the end piece side and wherein the mechanism consists of a U-shaped metal frame with a locking member, which is mounted by means of pins in its lateral recesses, for the locking of the tongue of the end piece, of a spring-loaded ejector, actuating the tongue, of a spring-loaded locking member support to secure at least the stop location of the locking member and of a spring-loaded release button.

In the EP-OS 0 252 403 a belt lock of the above-mentioned type is described. In this lock, the locking member is of relatively complicated construction and has a considerable mass, so that the locking member has to be manufactured in a time-consuming manner and at high cost and, in addition, relativelyhigh frictional forces have to be overcome on its actuation. The locking member is a relatively large component and has a detent which is bent obliquely downwards for the locking with the tongue piece of the belt strap end piece, and which has to be bent accurately in order to ensure the functioning of the belt lock under all circumstances. In addition, the mass of this locking member is relatively great, so that in combination with the considerable frictional resistances on using the lock considerable actuating forces have to be applied.

In the EP-OS 0 083 752, a comparable belt lock is disclosed.

Also in the locking member of this lock, the disadvantages stated above are present, wherein the locking member is of more complicated construction.

The object of the invention consists in the improvement of a belt lock of the type indicated in the introduction to the effect that the locking member, its mounting and its actuation are further simplified, in order to be able to manufacture the belt lock at a more favourable cost and more simply, and also in order to be able to use it more easily.

The solution to this problem proceeds from the belt lock indicated in the introduction and is further characterised in that the locking member is an at least substantially flat component in the shape of a small plate, that the lateral recesses in the metal frame for the mounting and guiding of the pins of the locking member consist of elongated holes which extend parallel to the direction of movement of the tongue in the frame and are dimensioned such that the pins are guided so as to be movable in the direction of movement of the tongue, but vertically thereto and at least in the locking position of the locking member substantially free of play, that the cross-piece of the U-shaped metal frame has a stop for the fixing of the stop location of the locking member, that the front upper region of the locking member forms a stop for the purpose of unlocking the locking member by the release button, and that the locking member support is arranged behind the locking member above the ejector and is movable at least substantially parallel to the direction of movement of the ejector.

Through this solution, the locking member is further simplified in its shape. It is able to be produced by a single punching process and does not require any bending operations for further fashioning. Its smaller structural size, which is brought about thereby, leads to a smaller mass with the advantage that this member, consisting of metal, now requires less actuating forces. The latter is also because it is exposed to smaller frictional forces on its closing and opening actuation, especially since according to the invention it is in principle mounted in the elongated holes with a relatively large play. However, in each case a secure stop location of the locking member is achieved, because on the one hand it is not movable in transverse direction to the longitudinal extent of the lateral elongated holes, at least in the stop location, and on the other hand it rests beneath on the metal frame of the belt lock. The rearward, correspondingly well spring-mounted locking member support presses onto the reverse side of the locking member, in order to prevent this member from falling out of its stop location. To open the belt lock, the locking member is pressed upward directly back by the release button, so that the locking member moves back in the two elongated holes and thereby comes into an oblique position such that it withdraws from the tongue of the belt strap end piece, so that the latter is unlocked.

The non-locking position of the locking member, which is substantially of rectangular construction, is secured by a rearwardly inclined oblique position thereof, which on the one hand is ensured by a rear higher abutting of the inclined locking member against the locking member support and on the other hand through an anterior lower abutting of the locking member against a housing part of the lock in connection with the upper abutting of the locking member pins against the elongated holes.

Figure 2:
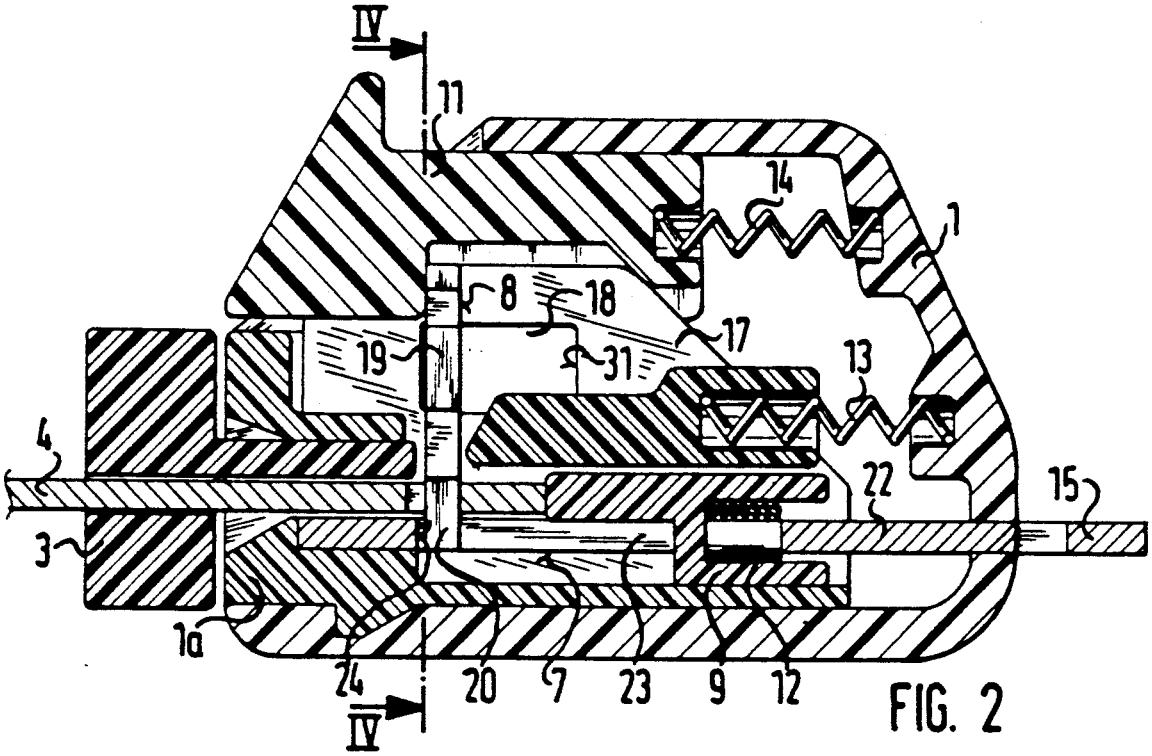
Figure 3:
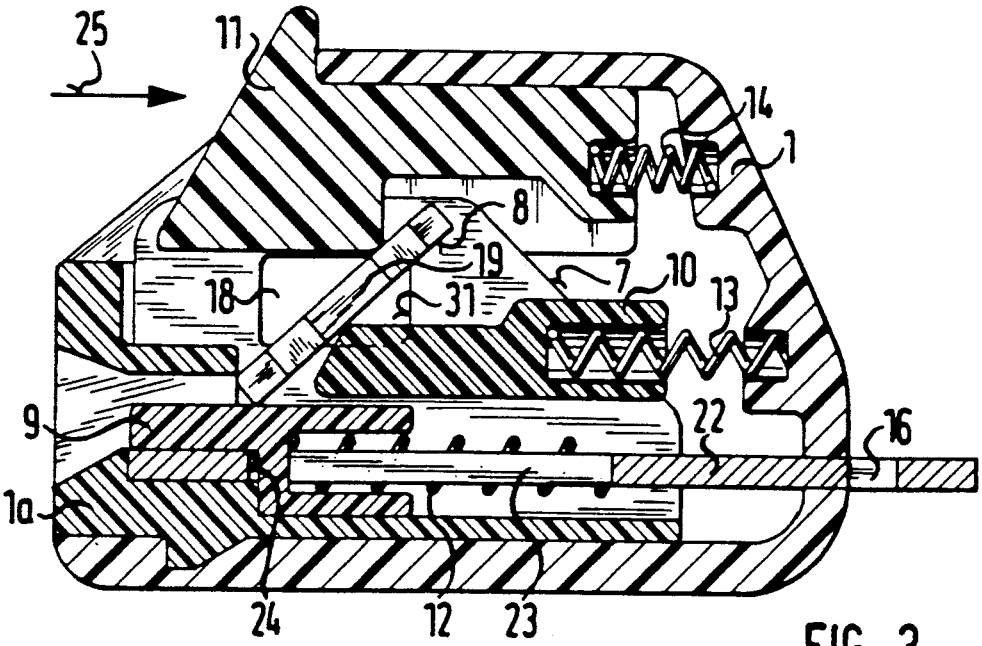
Figure 4:
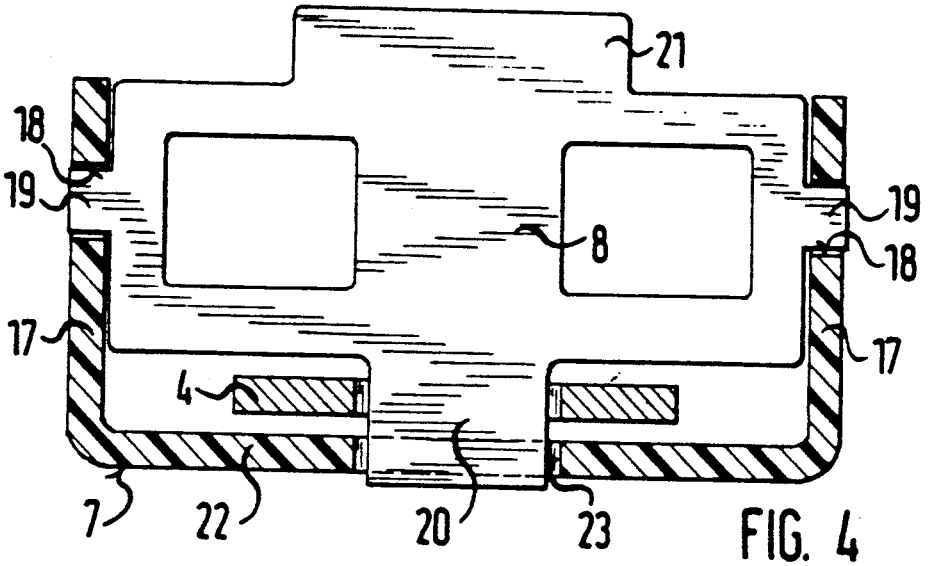
Figure 5:
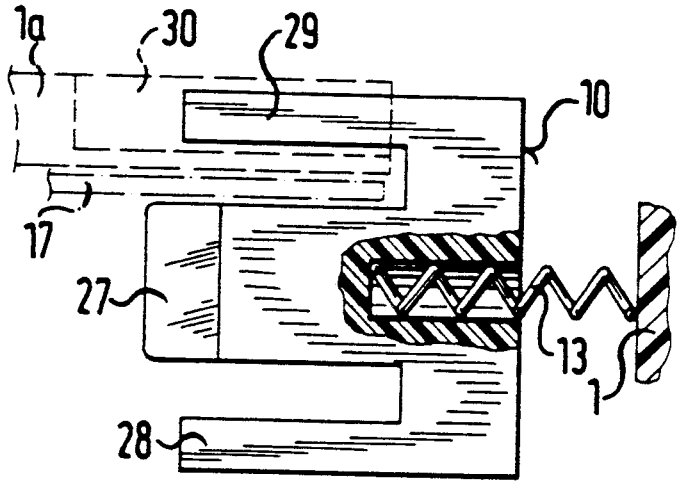

The invention is explained in further detail hereinbelow with the aid of an example embodiment represented in the attached drawings, in which:

FIGS. 1 to 3 in each case show central longitudinal sections through the example embodiment, and namely on the introduction of belt strap end pieces, after the locking of the end pieces and on the unlocking of the end pieces, wherein the latter are already ejected, FIG. 4 shows a simplified partial section according to the line IV—IV in FIG. 2, FIG. 5 shows a top view onto an individual part of the example embodiment.

According to FIGS. 1 to 3, the belt lock principally consists of a lock housing 1 with a closing mechanism situated therein, and of two belt strap end pieces 2 and 3. With regard to one end piece 2, only the tongue 4 which is locked with its locking hole 5 with the mechanism is to be seen, whilst the other end piece 3 has a control member 6, which likewise comes into engagement with the mechanism. A single belt strap end piece may also be used, which then also has the control member 6. It is also possible to use more than two end pieces.

The above-mentioned mechanism comprises a U-shaped metal frame 7, a locking member 8, mounted thereon, for the locking of the tongue 4, a conventional ejector 9, loaded by a compression spring, for the unlocked tongue, a locking member support 10, which engages rearwardly on the locking member 8, and a release button 11, loaded by a compression spring, which button engages upwardly on the locking member and is preferably movable parallel to the direction of movement of the tongue 4. For the parts 9, 10 and 11 preferably a spiral compression spring 12, 13 and 14 is used. The cross-piece of the metal frame 7 has a rear extension 15 with a hole 16, to which a belt strap (not shown) is attached in a known manner.

The two shanks 17 of the U-shaped metal frame 7 which lie opposite each other (FIG. 4) each have a rectangular elongated hole 18 for the mounting and guiding of the locking member 8, and which are arranged such that the two elongated holes extend parallel to the direction of movement of the tongue 4 in the mechanism and are each provided in a region of the shanks 17 which lies approximately over the locking hole 5 of the tongue 4, when the latter is engaged in the mechanism.

The locking member 8 (FIG. 4) which has the shape of a small plate and is of substantially rectangular construction, has on its short sides in each case a pin 19, wherein the pins are held and guided in the elongated holes 18, as can be seen from the FIGS. 1 to 3. The locking member additionally has a lower central detent 20, which engages into the locking hole 5 of the tongue 4, and an upper stop 21, which serves for the unlocking of the mechanism by the release button 11. The locking member 8 is preferably of flat construction, but may also be slightly curved, for example in its upper region, and consists of metal, for example.

The width of the pins 19 corresponds substantially to the height of the elongated holes 18, so that the locking member 8, when it stands vertically, as FIGS. 2 and 4 show, cannot move in vertical direction, in this respect is therefore fixed. However, the pins can move in the longitudinal direction of the elongated holes, and namely owing to the length of the elongated holes which is greater by a multiple with respect to the thickness of the pins, so that the locking member according to FIGS. 1 and 3 can assume an inclined position, which is the position of the locking member out of the stop location.

The metal frame 7 has in its cross-piece 22, connecting the two shanks 17, a conventional elongated guide recess 23 to receive and axially guide the ejector 9 of known construction, which in connection with the compression spring 12 ejects the tongue 4 of the end piece 2 when the locking member 8 is unlocked. The locking member 8 also rests on the ejector 9, when the locking member is unlocked (FIGS. 1 and 3). The front end of the recess 23, formed as a punched hole, at the same time also serves as a stop 24 for the detent 20 of the locking member, when the latter is engaged (FIG. 2), so that also thereby the stop location of the locking member is ensured.

Above the ejector 9 and behind the locking member 8, the locking member support 10 is arranged, and namely at least substantially axially movable parallel to the direction of movement of the ejector, so that the support 10 moves forward on locking the tongue 4, owing to the compression spring 13, and moves back according to the arrow 25 on pressing the release button 11. As FIGS. 1 and 3 show, the support 10 engages on the locking member 8 to the rear approximately centrally, and thus brings about an engagement moment on the locking member, as the latter is temporarily fixed in the region of its detent and during its unlocking time on a supplementary piece 1*a* of the housing 1. The parts 1 and 1*a* are connected with each other so as to be secure with regard to their position by means of a conventional stop connection 26. The front end of the locking member support has a curvature 27 as an improved working surface for a facilitated movement of the locking member.

As can be better seen from FIG. 5, the locking member support 10 has two lateral arms 28 and 29, with which it is guided in elongated recesses 30 of the housing part 1*a*, which is indicated by dotted lines, as is clear to the specialist without further explanation.

Preferably, the rearwardly inclined position of the locking member 8, representing an unlocking position, is secured in that the locking member on the one hand is supported to the rear by the support 10 at a higher region and on the other hand is supported by an anterior lower abutment against the housing part 1*a* and against the ejector 9 and also by an upper abutment of the locking pin 19 against the upper edge of the elongated holes 18.

Alternatively, the unlocking position of the locking member can also be secured in that the lateral elongated holes 18 for the holding and guiding of the pins of the locking member have a length such that instead of the rear locking member support 10, the rear delimitation of the elongated holes on the one hand each form a rear stop for the pins when the locking member 8, which is out of engagement, is in the inclined position, and that the inclined position on the other hand exists through an anterior lower abutment against the housing part 1*a* and against the ejector 9 and also in connection with the upper abutment of the locking member pins against the elongated hole edges.

The elongated holes 18 in the shanks 17 of the metal frame 7 are preferably of rectangular construction. However, they may also have a shape which widens slightly toward the rear. It is also possible that the elongated holes 18 do not extend exactly parallel to the direction of movement of the tongue 4 of the corresponding belt strap end piece 2, but rather have a direction slightly inclined thereto. However, it must be ensured that the locking member 8 can be moved into an inclined position from which it can be securely brought into its locking position.

The described belt lock functions in the following manner. The two belt strap end pieces 2,3, which have been previously put together, are inserted into the remaining lock, wherein the tongue 4 firstly comes to rest against the ejector 9 alone and pushes it back against the spring tension 12. Thereby the locking member 8, supported by the locking member support 10, falls onto the tongue 4. As soon as the tongue 4 reaches its locking position, the control member 6 of the end piece 3 comes to rest against the detent 20 of the locking member 8 and brings it about that the locking member 8, with further support by the support 10, catches into the hole 23 of the frame 7 and comes to rest against its stop 24. Consequently, the locking member 8 has moved from its inclined position according to FIG. 1 into its locking position according to FIG. 2. The locking member can not come out of this latter position spontaneously, because it is prevented from doing so by its pins 19, which rest against the upper edge of the elongated holes 18, in connection with the locking member support 10. If the release button 11 is now pressed in the direction of arrow 25 (FIG. 3), the locking member 8 is pressed toward the rear, at which the support 10 likewise shifts toward the rear against the force of the spring 13, whereby the detent 20 of the locking member 8 moves upward and consequently frees the tongue 4 of the corresponding end piece again. The ejector 9 then moves the tongue 4 out of the lock mechanism and itself arrives into its initial position shown in FIGS. 1 and 3, in which the locking member 8 also rests on the ejector 9.

I claim:

1. A belt lock for a belt strap retaining system, comprising:

a belt strap end piece having a locking tongue and a control member, a closure mechanism arranged and constructed to receive said tongue and said control member, a V-shaped metal frame having elongated lateral guide recesses, said lateral recesses extending in a direction substantially parallel with an insertion path and being arranged and constructed to guide said pins in a parallel direction without vertical play, a substantially flat plate locking member mounted in said frame, said locking member engageable by said control member to lock said tongue in said frame, pins disposed in said recesses, said pins arranged and constructed to mount said locking member in said frame, a spring loaded ejector arranged and constructed to eject said tongue from said closure mechanism, a spring loaded locking member support movable in a direction substantially parallel with an insertion path, said locking member support arranged and constructed to secure said locking member in a tongue locking position, said locking member support disposed behind said locking member, above said ejector, a spring loaded release button arranged and constructed to move said locking member to a tongue releasing position, a cross piece disposed on said frame, a first stop disposed on said cross piece, said first stop arranged and constructed to stop and lock said locking member in a locking position, and a second stop disposed at an upper region of said locking member, said second stop arranged and constructed to engage said release button and move said locking member to said releasing position.

2. A belt lock according to claim 1, further comprising a longer lower locking member edge and a shorter lateral locking member edge, and a detent disposed on said lower edge, said detent arranged and constructed to lock said tongue, wherein said locking member is substantially rectangular.

3. A belt lock according to claim 1, further comprising a closure mechanism housing, and a helical compression spring arranged and constructed to urge said support against said locking member in an insertion direction, wherein an engagement moment is exerted on said locking member.

4. A belt lock according to claim 1, further comprising a locking mechanism housing, rearward upper abutments engageable by said locking member support, a forward lower abutment engageable with said locking mechanism housing, said pins engaged against edges of said elongated guide recesses in said frame, whereby said locking member is retained in a rearwardly inclined engagement, out of engagement with said tongue.

5. A belt lock according to claim 1, further comprising a closure mechanism housing, a forward lower abutment on said locking member engaging said closure mechanism housing, said locking pins engaging edges of said elongated guide recesses, said elongated guide recesses having rear ends arranged and constructed to stop said pins in a rearwardly inclined position of said locking member out of engagement with said tongue, wherein said locking member is retained in an inclined position.

6. A belt lock according to claim 1, wherein said first stop comprises a punched hole in said frame.

7. A belt lock according to claim 1, wherein said locking member support has a curved surface arranged and constructed to abut said locking member.

* * * * *